United States Patent [19]

Sujdak

[11] 4,224,180

[45] Sep. 23, 1980

[54] COLD END ADDITIVE COMPOSITIONS

[75] Inventor: Richard J. Sujdak, Morrisville, Pa.

[73] Assignee: Betz Laboratories, Inc., Trevose, Pa.

[21] Appl. No.: 89,680

[22] Filed: Oct. 30, 1979

Related U.S. Application Data

[63] Continuation-in-part of Ser. No. 19,686, Mar. 12, 1979, abandoned, which is a continuation-in-part of Ser. No. 950,960, Oct. 13, 1978, Pat. No. 4,185,071.

[51] Int. Cl.[3] ..... C23F 11/00; C23F 11/02

[52] U.S. Cl. ..... 252/392; 422/9; 44/72; 423/242; 423/243; 110/343; 110/345

[58] Field of Search ..... 252/392; 44/72, 77; 422/9; 110/343, 345; 423/229, 242, 243, 244

[56] References Cited

U.S. PATENT DOCUMENTS

| | | | |
|---|---|---|---|
| 2,106,446 | 1/1938 | Baehr et al. | 423/229 |
| 4,096,085 | 6/1978 | Holoman, Jr. et al. | 252/392 |
| 4,134,728 | 1/1979 | Libutti et al. | 422/9 |

*Primary Examiner*—Jacqueline V. Howard

*Attorney, Agent, or Firm*—Alexander D. Ricci; Steven H. Markowitz

[57] ABSTRACT

The present invention is drawn to ethylene polyamines in combination with certain alkanolamines as cold-end additives. More specifically, it has been discovered that if these additives are fed to the moving combustion gases of a combustion system which uses sulfur containing fuel and upstream of cold-end surfaces to be treated, the additive will travel along with the gases as vapor and/or liquid droplets and deposit on the cold-end surfaces. As a result, the amount of sulfuric acid corrosion of metallic cold-end surfaces is reduced.

5 Claims, 5 Drawing Figures

COLD END ADDITIVE COMPOSITIONS

Figure 2:
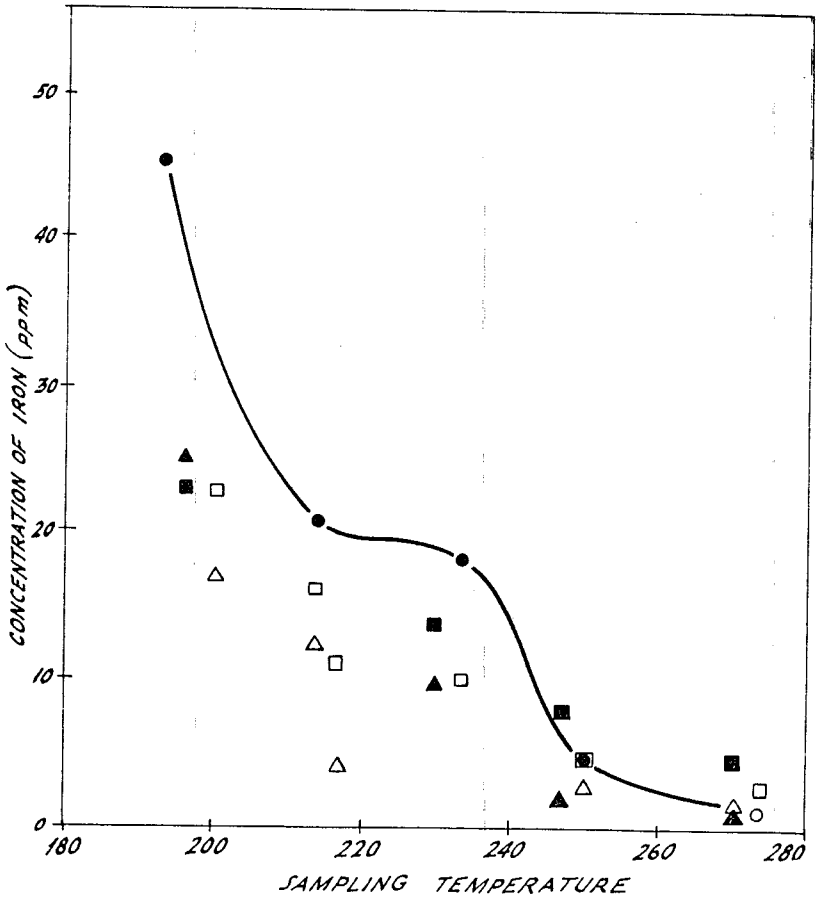

This is a continuation-in-part of U.S. patent application Ser. No. 19,686, filed Mar. 12, 1979, now abandoned; which is a continuation-in-part of U.S. patent application Ser. No. 950,960 filed Oct. 13, 1978 now U.S. Pat. No. 4,185,071, both of which specifications are incorporated herein by reference.

TECHNICAL FIELD

As is well known to boiler operators, sulfur-containing fuels present problems not only from a pollutional point of view, but also with respect to the life and operability of metallic equipment and parts which are in contact with the flue gases containing the sulfur by-products of combustion. While the problem will be discussed herein with respect to boilers, it should be understood that both the problem and its solution could apply to other systems, such as process furnaces.

Upon combustion, the sulfur in the fuel is converted to sulfur dioxide and sulfur trioxide. In the flue gas, sulfur trioxide and water vapor are in equilibrium with sulfuric acid. Below about 450° F., essentially all of the $SO_3$ is converted to $H_2SO_4$ for typical flue gas compositions of oil fired boilers. The resulting sulfuric acid condenses upon metal surfaces which are at temperatures below the acid dewpoint. Corrosion results from the attack of the condensed sulfuric acid on the metals.

As can be appreciated, the greater the sulfur content of the fuel, the more sulfuric acid will likely be produced. This is particularly the case in industrial and utility operations where low grade oils are used for combustion purposes.

The basic area to which the present invention is directed is often referred to in the industry as the "cold-end" of a boiler. This area is generally the path in he boiler system that the combustion gases follow after the gases have, in fact, performed their primary service of producing and/or superheating steam.

In larger boiler systems, the last stages through which the hot combustion gases flow include the economizer, the air heater, the collection equipment or electrostatic precipitator, and then the stack through which the gases are discharged.

DESCRIPTION OF THE INVENTION

The use of alkanolamines alone as a cold-end additive is disclosed in U.S. patent application Ser. No. 955,829, filed Oct. 30, 1978 and in U.S. Pat. No. 4,134,728.

The present invention is drawn to the present inventor's discovery of ethylene polyamines in combination with aliphatic, water-soluble alkanolamines as cold-end additives. It was determined that if this additive is fed, preferably as an aqueous solution and in droplet form, to the moving combustion gases upstream of the cold-end surfaces to be treated and preferably at a point where the gases are undergoing turbulence, it will travel along with the gases as vapor and/or liquid droplets and deposit on the downstream cold-end surfaces. It is understood that any reference to ethylene polyamine is intended to include mixtures of such compounds and any reference to alkanolamine is intended to include mixtures thereof. While a point of turbulence of the combustion gases is a preferred feed point for the additive, a point of laminar gas flow could also be used, provided that suitable mechanical means are utilized to create a zone of relative turbulence for proper treatment distribution. For example, an increased number of spray nozzles may be suitably arranged within a gas flow conduit to provide adequate treatment distribution.

The term "ethylene polyamine(s)" is intended to include hydrocarbon chains consisting of at least two amino groups connected by ethylene group(s). For example, the lowest homolog in the series would be ethylene diamine having the following structure:

$$NH_2—CH_2—CH_2—NH_2.$$

Also for example, a higher homolog in the series would be tetraethylenepentamine having the structure:

$$HN—(CH_2—CH_2—NH—CH_2—CH_2—NH_2)_2.$$

In terms of a general formula, ethylene polyamines according to the present invention could best be described by the following:

$$H_2N—CH_2(—CH_2—NH—CH_2—)_nCH_2—NH_2 \quad (I)$$

Since ethylene diamine is the lowest homolog in the series, the lower limit for n is 0. It is the present inventor's opinion that there is no upper limit for n in Formula I other than that based on he commercial availability of the material. In any event, the highest homolog tested was poly(ethylenimine) having the formula:

$$\text{-}(CH_2—CH_2—NH)\text{-}_n,$$

which material had an average molecular weight of about 50,000 to 100,000; and, therefore, n was about 1000 to 2500. While all of the compounds tested had ethylene groups connecting the amino groups, it is believed that other lower alkyl interconnecting groups could be used. For example, it is the present inventor's belief that trimethylene or tetramethylene groups are suitable equivalents for the ethylene group. However, preliminary testing was indicated that hexamethylene interconnecting groups are unsuitable for the purpose.

There are numerous well known methods available to the artisan for feeding the additive to the combustion gases. For example, the additive could be sprayed at a point of turbulence of the combustion gases upstream of the problem area using any well known atomizing spray nozzle(s). However, precautions should be taken to ensure that the problem areas will encounter treated flue gas. For instance, if the problem area is located centrally within a flow conduit for the combustion gases, the spray should be directed into the conduit in such as manner as to ensure that a sufficient amount of additive is present in the center of the conduit upon reaching the location of the problem area. Thus, an axially located spray nozzle which sprays the additive in the same direction that the combustion gases flow would be recommended for such a centrally located problem area. While the additive could be fed neat by simply adding the two components together, an aqueous solution is preferred.

The amount of additive used could vary over a wide range depending on the nature and severity of the problem to be solved and would be a function of the sulfur content of the oil. With respect to the ethylene polyamine, the particular species is also seen to be an important consideration with respect to feedrate. For example, for a fuel oil containing 1% sufur, 0.05 mole of triethylenetetramine per barrel (m/bbl) of fuel oil consumed has proven to be efficacious; while only 0.0004 mole of high molecular weight poly(ethylenimine) per barrel of fuel oil consumed (m/bbl) was required to do the job. It is the inventor's opinion that the upper limit would depend only on economic considerations. Accordingly, for fuel oil containing 1% sulfur (weight basis), the upper limit would be considered to be about 1 m/bbl based on economic considerations, with about 0.5 m/bbl representing a preferred upper limit. The active alkanolamine could be fed in an amount as low as about 0.05 m/bbl. The preferred lower limit is about 0.1 m/bbl. Based on economic considerations, the amount of active alkanolamine could be as high as about 1 m/bbl, with about 0.75 m/bbl, representing the preferred upper limit. Accordingly, the inventive additive is considered to comprise from about 0.0004 to about 0.95 m/bbl of ethylene polyamine and from about 0.05 to about 1 m/bbl of alkanolamine. The preferred relative proportions are from about 0.1 to about 0.5 m/bbl ethylene polyamine and from about 0.1 to about 0.75 m/bbl alkanolamine. Based on economic considerations, the total amount of active additive should not exceed about 1.1 m/bbl. On a weight basis, the ratio of alkanolamine to ethylene polyamine is about 25:1 or less.

The temperature of the combustion gases at the point of feed is typically about 400° F. to 750° F., but this range could widen depending on the gas temperature at the furnace exit.

EXAMPLES

EXAMPLE 1

In order to assess the efficacy of the ethylene polyamines, various tests were conducted using a D-type boiler manufactured by Keeler. The boiler is rated at 26,000 pounds of steam per hour and is normally operated at 200 psig pressure.

Since the primary function of a cold-end additive is to eliminate or reduce corrosion caused by the condensation of sulfuric acid, techniques that measure corrosion were expected to yield the most direct information about product performance. Accordingly, the well known method of quantifying the reduction in corrosion of a stainless steel air-cooled probe was used for determining efficacy as cold-end additives. The probe used was similar to a standard British Central Electricity Research Laboratories (CERL) acid deposition probe. The construction and operation of this probe are well known in the art as evidenced by an article entitled "An Air-Cooled Probe for Measuring Acid Deposition in Boiler Flue Gases" by P. A. Alexander, R. S. Fielder, P. J. Jackson and E. Raask, page 31, Volume 38, *Journal of the Institute of Fuel*; which article is hereby incorporated by reference to indicate the state of the art. Flue gas constituents were allowed to condense on the probe for 45 minutes. The probe was then immediately washed with doubly distilled water and analyzed for iron and sulfate. Corrosion was measured by analyzing the probe washings for water soluble iron, which is also a well known technique.

Since a cold-end additive should be capable of travelling along with the combustion gases and depositing on the downstream cold-end surfaces to be treated, the various additives tested were sprayed, using a standard atomizing spray nozzle arrangement, into the combustion gases at a point of turbulence located upstream of the air-cooled probe.

Immediately before base loading, the boiler was taken through a soot blowing cycle, and the burner tip was manually cleaned. The boiler was then base loaded for one hour prior to initiating testing. Fuel oil of precisely the same composition was fired over a given period of time to ensure reproducibility of baseline data throughout the period. However, for critical testing, daily determination of baseline data is recommended. The boiler was fired with number 6 grade fuel oil containing 1% sulfur (by weight). The oil was preheated to 170° F. and atomized with steam. Combustion air was at ambient temperature. Flue gas temperatures at the sampling point ranged from 440° F. to 480° F. The sulfuric acid dewpoint using either a Land Dewpoint Meter or a corrosion probe was typically 262° F. Using a Research Appliance Corporation sampling device, the concentration of $SO_3$ was determined to be about 7 parts per million parts of combustion gas (ppm, on volume basis).

The materials tested were ethylene diamine, available from Union Carbide; diethylenetriamine, obtained from Fisher: triethylenetetramine, obtained from Aldrich; tetraethylenepentamine, obtained from Aldrich; poly(ethylenimine), also obtained from Aldrich; and ethylamine, obtained from Pennwalt.

The results of a series of tests are reported below in Table 1, wherein a different test number indicates that tests were conducted on a different day. The % $O_2$ reported is the oxygen content of the combustion gas on a volume basis. The additive feedrates are reported as mole(s) of feed per barrel of fuel oil consumed (mole/bbl), and the probe corrosion results are reported as % reduction in iron content of the probe washings for the indicated temperatures as compared to base condition corrosion.

TABLE 1

| Test | Additive | % $O_2$ | Steam Load (pph × $10^{+3}$) | Additive Feedrate (mole/bbl) | % Reduction in (Fe) 190° F. | 200° F. | 210° F. | 230° F. | 250° F. |
|---|---|---|---|---|---|---|---|---|---|
| 1 | diethylenetriamine | 5.3 | 13.0 | .43 | 89 | | 96 | 93 | 56 |
| 2 | diethylenetriamine | 6 | 13.5–14 | .13 | 60 | | 52 | 73 | 0 |
| | ethylamine | 6 | 13.5–14 | .12 | 0 | | Very Corrosive | | |
| 3 | diethylenetriamine | 6.0 | 14.5–15.5 | .31 | 88 | | 87 | 88 | 75 |
| | triethylenetetramine | 6.0 | 14.5–15.5 | .34 | 93 | | 96 | 94 | 75 |
| 4 | triethylenetetramine | 6.0 | 15.5–16.5 | .054 | | 21 | 42 | 50 | 46 |
| 5 | diethylenetriamine | 6.0 | 14.5–15.5 | .088 | | | 0 | 27 | 0 |
| 6 | triethylenetetramine | 6.0 | 14.5–15.5 | .066 | | 33 | 49 | 54 | 40 |
| 7 | triethylenetetramine | 6.0 | 13–14 | .06 | 25 | | 42 | 40 | 75 |
| 8 | triethylenetetramine | 6.0 | 14–15 | .081 | | 40 | 53 | 57 | 43 |
| 9 | triethylenetetramine | 6.0 | 14–15 | .09 | | 40 | 41 | 49 | 66 |
| 10 | diethylenetriamine | 6.0–6.2 | 15 | .12 | | 27 | 45 | 31 | 0 |
| | triethylenetetramine | 6.0–6.2 | 15 | .084 | | 0 | 21 | 31 | 0 |
| | tetraethylenepentamine | 6.0–6.2 | 15 | .055 | | 13 | 52 | 48 | 0 |

TABLE 1-continued

| Test | Additive | % $O_2$ | Steam Load (pph × $10^{+3}$) | Additive Feedrate (mole/bbl) | % Reduction in (Fe) 190° F. | 200° F. | 210° F. | 230° F. | 250° F. |
|---|---|---|---|---|---|---|---|---|---|
| 11 | triethylenetetramine | 6.0 | 15.5–17 | .09 | | 46 | 78 | 49 | 77 |

As can be seen from Table 1, the ethylene polyamines tested were quite effective in reducing the corrosion of the test probe. On the other hand, the ethylamine tested, which is known as a neutralizing agent for $SO_x$ gases in wet scrubbers, was ineffective. It was, accordingly, the present inventor's conclusion that the ethylene polyamines are effective cold-end additives while ethylamine is not.

Figure 1:
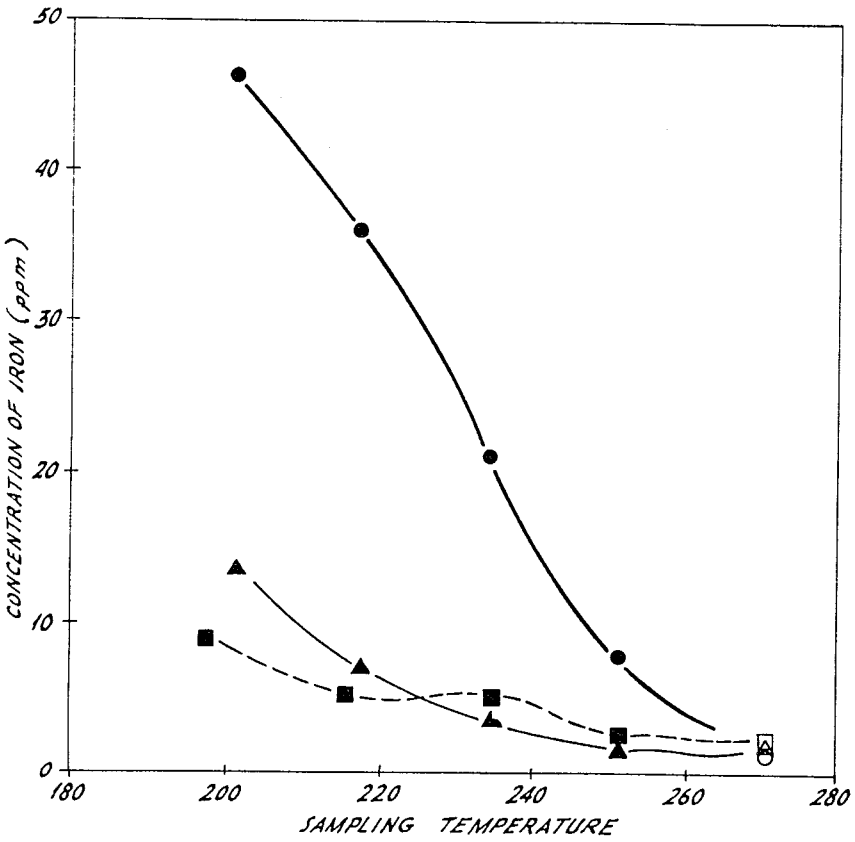

In FIG. 1 are reported the results of additional tests comparing ethylene diamine and poly(ethylenimine) to base conditions. The poly(ethylenimine) had a molecular weight average of about 50,000 to 100,000 such that n in Formula I above would be about 1000 to 2500. As can be seen from the figure, the results are graphically reported as a plot of concentration of iron in the probe washings, in ppm, against the sampling temperature °F. The results for base conditions are represented by solid circles, the results for ethylene diamine are represented by solid squares, and the results for poly(ethylenimine) are represented by solid triangles. During the test period, the boiler was operated at approximately 12,000–13,000 pounds of steam per hour with oxygen being about 6% of the flue gas. The ethylene diamine was fed at a rate of 0.38 mole/bbl of fuel oil consumed, and the poly(ethylenimine) was fed at a rate of 36.3 milliliters per barrel of oil consumed. Due to the uncertainty of the exact molecular weight of the poly(ethylenimine), no exact molar feedrate was calculable. However, based on the noted molecular weight range for the material and a density of approximately 1 gram per milliliter, the feedrate was about 0.0004 to 0.0007 mole/bbl.

As can be seen from FIG. 1, the ethylene polyamines did indeed significantly reduce corrosion as compared to base conditions.

EXAMPLE 2

In order to assess the efficacy of the alkanolamines, tests were conducted using the D-type boiler described in Example 1 above.

The well known method of quantifying the reduction in corrosion of the above-described air-cooled probe was again used for determining efficacy as cold-end additives. Flue gas constituents were allowed to condense on the probe for 45 minutes. The probe was then immediately washed with doubly distilled water and analyzed for iron and sulfate. Corrosion was measured by analyzing the probe washings for water soluble iron.

The various additives tested were sprayed, using a standard atomizing spray nozzle arrangement, into the combustion gases at a point of turbulence located upstream of the air-cooled probe.

Immediately before base loading, the boiler was taken through a soot blowing cycle, and the burner tip was manually cleaned. The boiler was then base loaded for one hour. Fuel oil of precisely the same composition must be fired over a given period of time to ensure reproducibility of baseline data throughout the period. However, for critical testing, daily determination of baseline data is recommended.

The boiler was fired with number 6 grade fuel oil containing 1% sulfur (by weight). The oil was preheated to 170° F. and atomized with steam. Combustion air was at ambient temperature. Flue gas temperatures at the sampling point ranged from 440° F. to 480° F. The sulfuric acid dew point using either a Land Dew Point meter or a corrosion probe was typically 262° F. Using a Research Appliance Corporation sampling device, the concentration of $SO_3$ was determined to be about 7 parts per million parts of combustion gas (ppm, on volume basis). The oxygen content of the flue gas was kept at about 6%.

The materials tested were monoethanolamine, obtained from Fisher; 2-(ethylamino)ethanol, obtained from Fisher; 3-amino-1-propanol, obtained from Eastman; 2-amino-2-methyl-1 propanol, obtained from IMC; 2-dibutyl-aminoethanol, obtained from Eastman; 2-amino-2-ethyl-1,3 propanediol, obtained from Aldrich; 1-amino-2-propanol, obtained from Eastman; triethanolamine, obtained from Eastman; and diisopropanolamine, obtained from Dow.

The results of a first series of tests are reported below in Table 2, wherein a different test number indicates that tests were conducted on a different day.

The additive feedrates are reported as mole(s) of additive per barrel of oil consumed (m/bbl), and the probe corrosion results are reported as % reduction in iron content of the probe washings for the indicated temperatures as compared to base condition corrosion. Negative results indicate a condition of increased corrosion of the probe as compared to base conditions. The steam loads are reported as pounds per hour (pph).

TABLE 2

CORROSION INHIBITION OBTAINED WITH A NUMBER OF ALKANOLAMINES

| Test | Additive | Steam Load (pph × $10^3$) | Mole of Additive/ bbl. of Oil Consumed | % Reduction in Fe vs. Temperatures, °F. 205 | 215 | 225 | 235 |
|---|---|---|---|---|---|---|---|
| 1 | 2-(ethylamino)-ethanol | 11–12 | 1.0 | 95 | 93 | 95 | 92 |
| | 3-amino-1-propanol | 11–12 | 1.0 | 97 | 95 | 96 | 93 |
| | 2-amino-2-methyl-1-propanol | 11–12 | 1.0 | 96 | 93 | 92 | 88 |
| | 2-dibutyl-aminoethanol | 11–12 | 1.0 | 60 | 48 | 45 | 23 |
| 2 | 2-(ethylamino)-ethanol | 11–13 | 0.5 | 58 | 50 | 44 | 35 |
| | 3-amino-1-propanol | 11–13 | 0.4 | 48 | 41 | 36 | 30 |
| | 2-amino-2-methyl-1-propanol | 11–13 | 0.3 | 6 | −15 | −33 | −49 |
| 3 | 2-amino-2-ethyl-1,3-propanediol | 12.5–13.8 | 0.4 | 67 | 55 | 51 | 48 |
| | 1-amino-2-propanol | 12.5–13.8 | 0.4 | 35 | 34 | 35 | 26 |

TABLE 2-continued

CORROSION INHIBITION OBTAINED WITH A NUMBER OF ALKANOLAMINES

| Test | Additive | Steam Load (pph × $10^3$) | Mole of Additive/ bbl. of Oil Consumed | % Reduction in Fe vs. Temperatures, °F. 205 | 215 | 225 | 235 |
|---|---|---|---|---|---|---|---|
| | diethanolamine | 12.5–13.8 | 0.4 | 62 | 53 | 49 | 38 |

As can be seen from the results reported in Table 2, a variety of alkanolamines demonstrated cold-end additive efficacy.

The results of a second series of tests are reported below in Table 3, wherein a different test number indicates that tests were conducted on a different day. The additive feedrates are reported as mole per barrel of oil consumed (mole/bbl), and the corrosion results are reported as % reduction in iron content of the probe washings for the indicated temperatures. These test results are seen to demonstrate the ability of the alkanolamines tested to reduce cold-end corrosion.

TABLE 3

| Test | Additive | Steam Load (pph × $10^3$) | Additive Feedrate (mole/bbl) | % Reduction in (Fe) 190° F. | 200° F. | 210° F. | 230° F. | 250° F. |
|---|---|---|---|---|---|---|---|---|
| 1 | N-aminoethyl ethanolamine | 11–11.5 | 0.88 | 94 | | 65 | 42 | 27 |
| 2 | monoethanolamine | 11.5 | 0.84 | 85 | | 74 | 33 | 0 |
| 3 | 2-amino-2-methyl-1-propanol | 13.0 | 0.42 | 58 | | 47 | 25 | Corrosive |
| 4 | monoethanolamine | 13.0 | 0.46 | 56 | | 52 | 38 | Corrosive |
| 5 | monoethanolamine | 13.5–14 | 0.12 | 36 | | 40 | 42 | 0 |
| | N-aminoethyl ethanolamine | 13.5–14 | 0.12 | 39 | | 11 | 51 | 0 |
| | triethanolamine | 13.5–14 | 0.13 | 25 | | −24 | 18 | 0 |
| 6 | monoethanolamine | 13–14 | 0.39 | 74 | | 48 | 50 | 0 |
| 7 | monoethanolamine | 13–14 | 0.34 | 83 | | 75 | 72 | 69 |
| 8 | monoethanolamine | 13.5–14.8 | 0.34 | | 25 | 36 | Corrosive | |
| 9 | diisopropanolamine | 13.5–14.8 | 0.36 | | 23 | | CORROSIVE | |
| 10 | monoethanolamine | 14.2–15.5 | 0.31 | | 46 | 36 | 36 | 31 |
| | 2-ethylamino ethanol | 14.2–15.5 | 0.31 | | 41 | 27 | 26 | 0 |
| | N-aminoethyl ethanolamine | 14.2–15.5 | 0.33 | | 79 | 78 | 87 | 73 |
| | monoethanolamine | 14.2–15.5 | 0.31 | | 46 | 36 | 36 | 31 |
| 11 | 2-dibutylaminoethanol | 15–16 | 0.37 | | 40 | 27 | 12 | Corrosive |
| 12 | 3-amino-1-propanol | 13.5–14.5 | 0.36 | | 43 | 13 | 24 | 0 |
| | 1-amino-2-propanol | 15.5–16.5 | 0.27 | | 38 | 0 | CORROSIVE | |

Having thus established the efficacy, individually, of ethylene polyamine and aliphatic, water-soluble alkanolamine as cold-end additives, the efficacy of combined treatments was evaluated in a further series of tests. Indeed, it is considered highly desirable to be able to combine the individual additives on an optimized cost basis. Furthermore, depending on the particular problem to be treated, it may be desirable to combine the additives to take advantage of the respective strengths of each and/or to possibly supplement the relative weaknesses of each.

The results of this further series of tests are reported in the accompanying drawings which contain graphic representations comparing various combinations of the ethylene polyamine and alkanolamine to base conditions. The materials tested were monoethanolamine (MEA), obtained from Fisher, and triethylenetetramine (TETA), obtained from both Fisher and Aldrich.

EXAMPLE 3

Using the same testing procedures as described in Example 2 above, the efficacy of the combined treatment was evaluated. The results of these tests are reported in FIGS. 2 and 3 as plots of concentration of iron in the probe washings, in ppm, against sampling temperature, °F. These tests results are to be interpreted according to the following legend presented in Table 4 below:

TABLE 4

Figure 3:
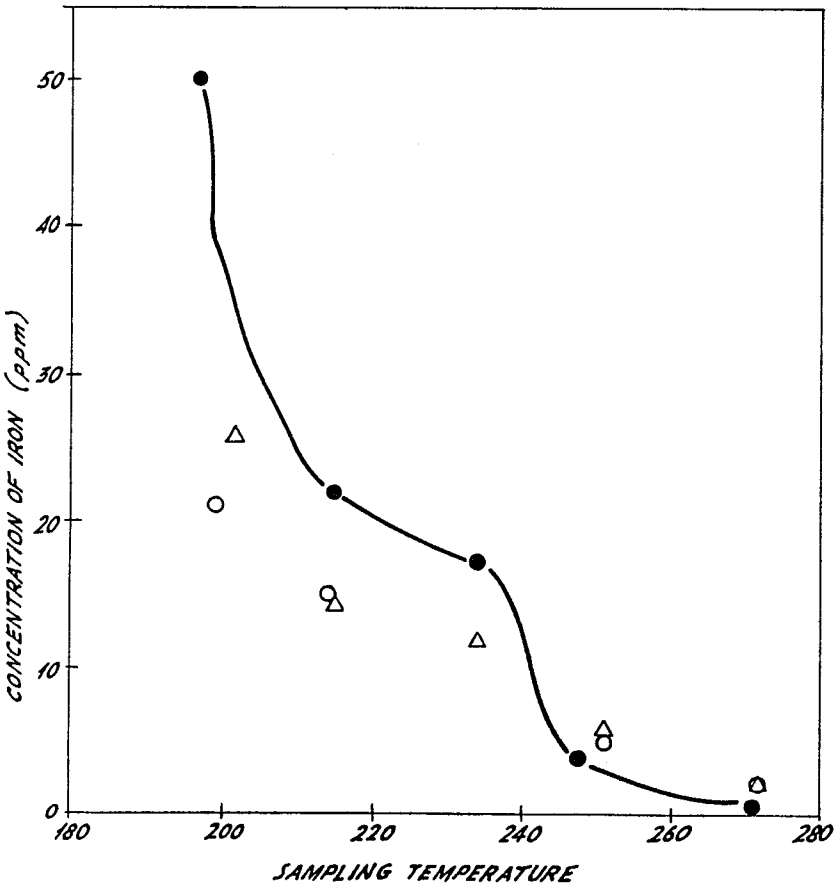

Legend For FIGS. 2 and 3

| FIG. | Symbol | Moles of MEA/bbl of Oil | Moles of TETA/bbl of Oil | Total Moles of Amine/ bbl of Oil |
|---|---|---|---|---|
| 2 | Solid Circle | 0 | 0 | 0 |
| 2 | Solid Square | 0.58 | 0 | 0.58 |
| 2 | Open Square | 0.45 | 0.022 | 0.472 |
| 2 | Open Triangle | 0.152 | 0.065 | 0.217 |
| 2 | Solid Triangle | 0 | 0.0858 | 0.0858 |
| 3 | Solid Circle | 0 | 0 | 0 |
| 3 | Open Circle | 0.382 | 0.0366 | 0.419 |
| 3 | Open Triangle | 0.257 | 0.054 | 0.311 |

EXAMPLE 4

The efficacy of various combined treatments was evaluated in tests using a boiler at a well-known oil refinery. The test procedures were generally the same as described in Example 2 above. The boiler was manufactured by Riley. During the tests, the boiler produced between 127,000 and 155,000 pounds of steam per hour, and it was baseloaded during each experiment. The generated steam was near 700° F. at 600 psig pressure. Flue gas temperatures at the location of the corrosion probe ranged from 685° F. to 720° F. The materials tested were MEA, and TETA, both obtained from Union Carbide. The results of these tests are reported in FIGS. 4 and 5 as plots of concentration of iron in the probe washings, in ppm, against sampling temperature (°F.). For FIG. 4, the sulfur content of the fuel oil was 0.69%, and for FIG. 5, it was 0.43%. These tests results are to be interpreted according to the following legend presented in Table 5 below:

TABLE 5

Figure 4:
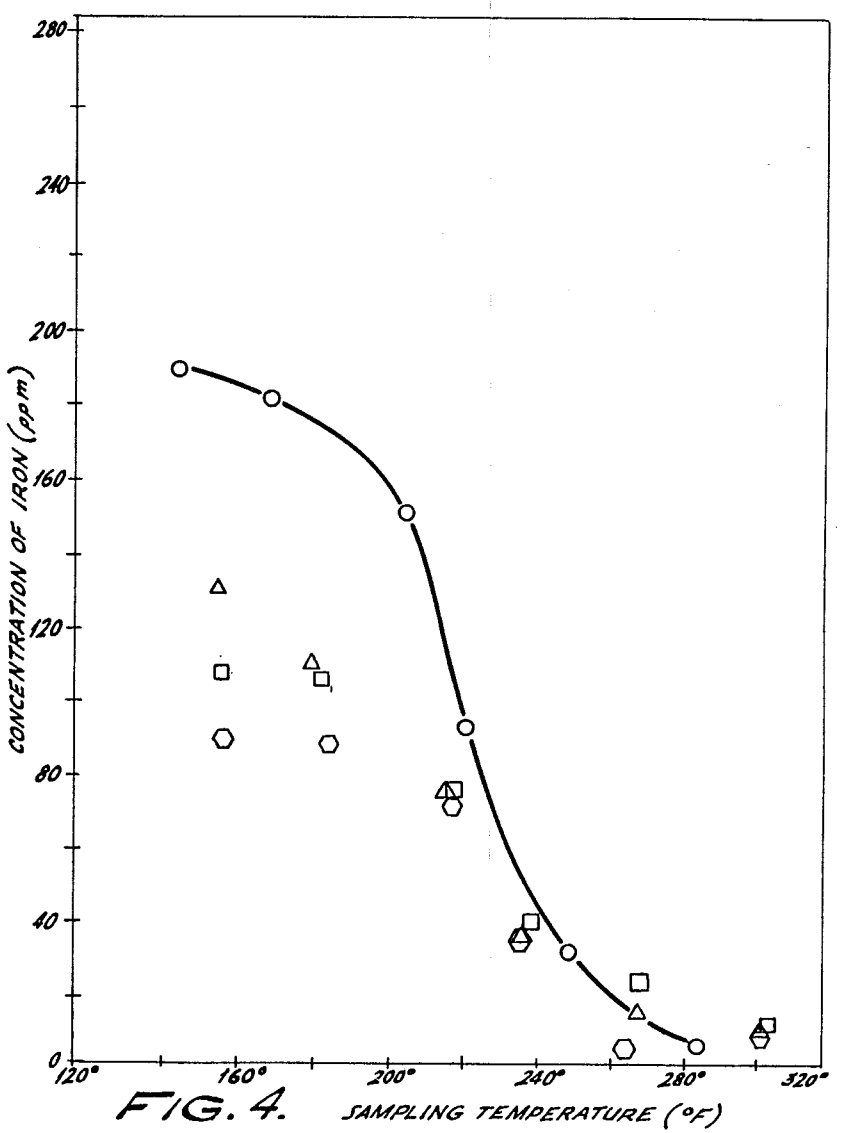
Figure 5:
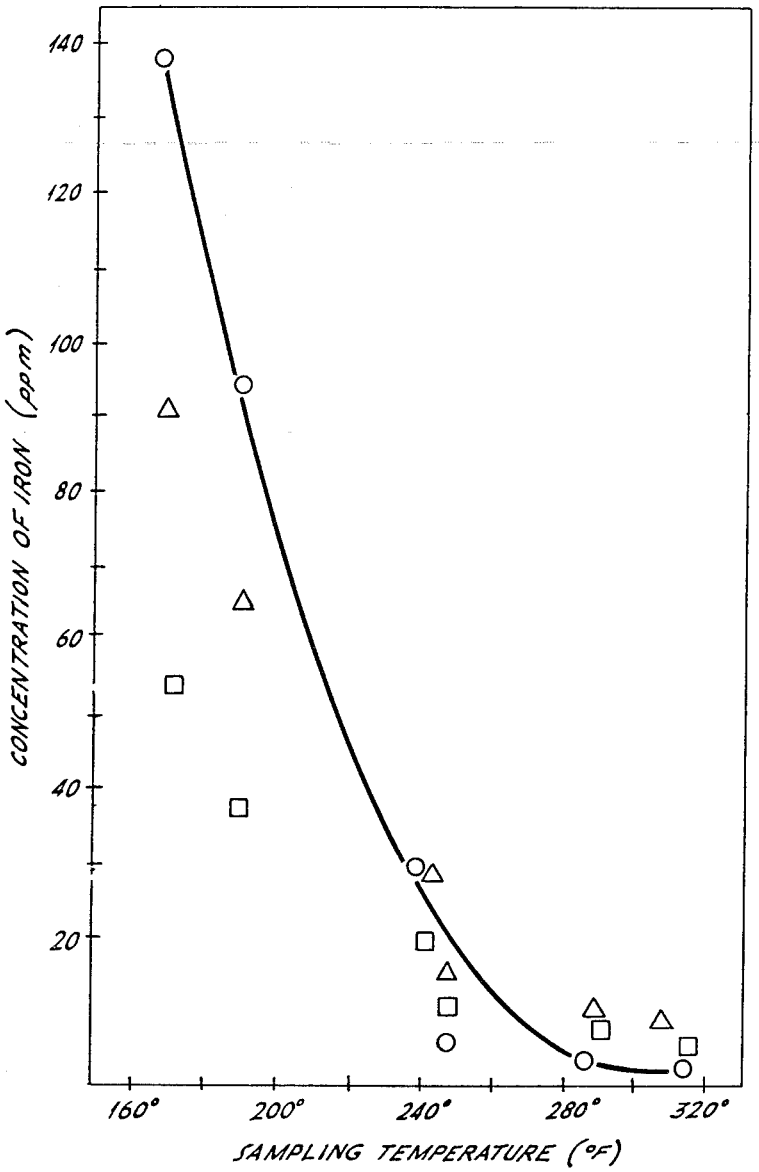

Legend For FIGS. 4 and 5

| Figure | Symbol | Moles of MEA/bbl of Oil | Moles of TETA/bbl of Oil | Total Moles of Amine/ bbl of Oil |
|---|---|---|---|---|
| 4 | Open Circle | 0 | 0 | 0 |
| 4 | Open Triangle | 0 | 0.088 | 0.088 |
| 4 | Open Hexagon | 0.141 | 0.0624 | 0.203 |
| 5 | Open Circle | 0 | 0 | 0 |
| 5 | Open Square | 0.131 | 0.058 | 0.189 |
| 5 | Open Triangle | 0.0873 | 0.0387 | 0.126 |

Based on the results reported above in Tables 1–3 and FIG. 1, which results are seen to demonstrate the efficacy, individually, of aliphatic, water-soluble alkanolamine and ethylene polyamine, and the results reported in FIGS. 2–5, a treatment composition comprising these materials in combination is seen to have efficacy as a cold-end additive. From FIG. 2 it can be seen that the product represented by the open triangle was more effective than either constituent alone. The mole ratio of the alkanolamine to ethylene polyamine for that product was about 2.3 to 1. On a weight basis this ratio is about 0.98:1.

Having thus described the invention, what is claimed is:

1. A cold-end additive composition for reducing the amount of sulfuric acid corrosion of metal parts at the cold-end of a combustion system in contact with combustion gases derived from the combustion of sulfur-containing fuel, said composition comprising in combination:

(i) aliphatic, water-soluble alkanolamine, and (ii) ethylene polyamine, wherein the weight ratio of alkanolamine to ethylene polyamine is 25:1 or less.

2. The composition of claim 1, wherein the ethylene polyamine includes a hydrocarbon chain having at least two amino groups which are ethylene-interconnected.

3. The composition of claim 1 or 2, wherein the alkanolamine is monoethanolamine.

4. The composition of claim 3, wherein the ethylene polyamine is triethylenetetramine.

5. The composition of claim 4, wherein the weight ratio of monoethanolamine to triethylenetetramine is about 0.98 to 1.

* * * * *